US006158460A

United States Patent [19]

Clark et al.

[11] Patent Number: 6,158,460

[45] Date of Patent: Dec. 12, 2000

[54] REMOVABLE PLUG FOR SEALING A PORT OF A FUEL DISTRIBUTION HEAD

[75] Inventors: G. Todd Clark, Maquoketa; Frederick A. Stebbins, Davenport, both of Iowa

[73] Assignee: Marley Pump, Davenport, Iowa

[21] Appl. No.: 09/349,904

[22] Filed: Jul. 8, 1999

[51] Int. Cl.[7] ..... B65D 53/00

[52] U.S. Cl. ..... 137/561 A; 138/96 T; 220/304

[58] Field of Search ..... 137/561 A; 138/89, 138/96 T; 220/304

[56] References Cited

U.S. PATENT DOCUMENTS

| | | | |
|---|---|---|---|
| 2,207,565 | 7/1940 | Wackman | 220/304 X |
| 2,689,058 | 9/1954 | Schmid | 220/304 |
| 2,752,814 | 7/1956 | Iaia . | |
| 3,087,370 | 4/1963 | Iaia . | |
| 3,172,567 | 3/1965 | Deters et al. . | |
| 3,172,572 | 3/1965 | Brown et al. . | |
| 3,175,454 | 3/1965 | Morse . | |
| 3,197,085 | 7/1965 | Deters et al. . | |
| 3,255,916 | 6/1966 | Rice | 220/304 |
| 3,893,487 | 7/1975 | Engelking | 138/89 |
| 3,951,172 | 4/1976 | Flegel | 138/89 |
| 3,993,102 | 11/1976 | Polster et al. | 138/89 |
| 4,432,394 | 2/1984 | Martin | 138/96 T |
| 5,176,215 | 1/1993 | Ackerman . | |
| 5,188,402 | 2/1993 | Colgate et al. | 220/304 X |
| 5,188,495 | 2/1993 | Jones, Jr. . | |
| 5,338,141 | 8/1994 | Hulsey . | |
| 5,547,042 | 8/1996 | Platt . | |

*Primary Examiner*—John Rivell
*Attorney, Agent, or Firm*—Sughrue, Mion, Zinn, Macpeak & Seas, PLLC

[57] ABSTRACT

An apparatus and method for sealing a port of a distribution head in a fuel dispensing system. A plug has a head, flange and threaded shank. The flange extends radially beneath the head and includes a seal engagement surface. A sealing member is positioned upon the seal engagement surface. The port has NPT threads formed therein for engaging with the threads of the plug. When the plug is fully engaged with respect to the port, so as to be bottomed out, a seal is formed between the plug and port while the threads of the plug and port do not achieve an interference fit, to allow for easy removal of the plug.

13 Claims, 6 Drawing Sheets

REMOVABLE PLUG FOR SEALING A PORT OF A FUEL DISTRIBUTION HEAD

BACKGROUND OF THE INVENTION

1. Field of the Invention

The present invention relates generally to fuel dispensing systems such as the type commonly installed at gasoline service stations and, more particularly, to a removable plug for sealing a testing port of a distribution head used in fuel distribution systems. Of course, the removable plug has general application for sealing a port and is, therefore, not limited to the fuel dispensing environment.

2. Description of the Related Art

Gasoline service stations normally have underground storage tanks from which the fuel is pumped to dispensing units. A typical installation makes use of a submersible electric motor driven pump in the storage tank which operates to pump gasoline or another fuel to a distribution head located above the tank. From the distribution head, the fuel is supplied to the dispensers. The flow path for the fuel includes a vertical column pipe which extends from the pump to the distribution head.

Many city codes require that pipelines from the distribution head to dispensing units be pressure tested for leaks. In order to conduct periodic testing and maintenance it is necessary to access various devices within the distribution head. This is done by removing a plug from a testing port and inserting a pressure gauge within the port. It is essential that the port is securely sealed because of fluid pressure that acts upon the plug during normal use. Typically, the plug is engaged in the port by either machine threads or the type of threads referred to by the American National Standards Institute (ANSI) as American National Standard Taper Pipe Threads (NPT).

Known fuel distribution systems which utilize such plugs include, U.S. Pat. No. 3,172,567, U.S. Pat. No. 3,172,572 and U.S. Pat. No. 3,197,085, issued Mar. 9, 1965, Mar. 9, 1965 and Jul. 27, 1965, respectfully. These systems describe header assemblies with a port and plug having machine type threads which are sealed with an o-ring. The plug tightens when it bottoms out at the top of the threads and the o-ring seals the joint; an interference fit is not formed between the threads on the plug and in the port. Any device which is threaded into the port must have machine type threads, and must rely on an o-ring to form a seal.

Other known fuel pumping systems, as shown in FIG. 7, utilize a plug 2 and port 4 having NPT threads 6. Typically, a sealant 8 is applied to the threads 6 of the plug 2 to create an air tight seal. The plug 2 is securely held in place by an interference fit which is formed between the threads 6 on the plug interfering with the threads 6 on the plug 2, as opposed to machine threads which rely on a positive stop formed by a bolt head, as mentioned above. The interference fit is caused by the thread's 6 tapered diameters which increasingly resist each other during engagement. However, the combination of the sealant 8 and thread interference result in a very tight fit which makes the plug 2 difficult to remove from the port 4. Furthermore, the port is often located within a manhole having limited clearance; thus, making the removal process of the plug even more difficult.

SUMMARY OF THE INVENTION

It is an object of the present invention to provide an apparatus and method for sealing a port of a distribution head in a fuel dispensing system. The apparatus and method permit the port to be quickly and easily accessed by a technician in the field. Accordingly, the present invention provides a plug which can be removed and inserted with a minimal amount of force while adequately sealing the port.

Although the apparatus and method are disclosed in the context of a fuel dispensing pumping system, it is a further object of the present invention to provide an apparatus and method for sealing a port or cavity generally.

More specifically, the present invention relates to a distribution head of a fuel dispensing system having a leak detector port with a plug, the distribution head comprising a plug which includes a head portion, a flange and a threaded shank for threadably engaging with American National Standard Taper Pipe Threads (NPT) formed within the port. The flange of the plug extends radially beneath the head portion, and has a seal engagement face surface. A sealing member is disposed on the seal engagement surface of the flange for forming a seal between the flange and the port. The plug bottoms out in a fully engaged position with respect to the port without forming an interference fit between the threaded shank of the plug and the NPT threads of the port.

The present invention still further provides an apparatus and method for sealing a port of a distribution head assembly in a fuel dispensing system. According to the invention, a distribution head is provided having an external surface and a port formed therein. The port has an internal threaded portion comprising NPT threads. A chamfer is formed at the opening of the port to provide an o-ring receiver. A plug is provided having a head, flange and shank. The flange extends radially beneath the head and includes a seal engagement surface. A sealing member, such as an o-ring, is positioned upon the seal engagement surface. The shank includes an externally threaded portion having, for example, NPT threads. In operation, the externally threaded portion of the plug is threadedly engaged with the internal threaded portion of the port. Accordingly, when the plug is turned relative to the port, the plug is threaded into the port until the flange is resisted by the external surface of the distribution head, wherein the o-ring is compressed between the seal engagement surface of the flange and the o-ring receiving portion of the port, thus, sealing the port.

In addition, the resistance formed by the external surface of the distribution head allows only a predetermined length (L) of external NPT threads of the plug to engage with the internal threads of the port. As a result, an interference fit between the NPT threads of the plug and the port is prevented. In other words, the rotation of the plug stops before an interference fit is accomplished. By preventing an interference fit the amount of force needed to insert and remove the plug is reduced. Also, the removal and insertion of the plug is easier due to the o-ring which is relied upon to provide a seal, as opposed to sealant applied to the threads. Thus, the testing process of the distribution head is more efficient, which translates into time and money savings.

The present invention still further provides an apparatus and method for sealing a distribution head port wherein a gland is formed on a top portion of the internally threaded portion of the port to protect the o-ring during compression.

The present invention also contemplates an apparatus and method for sealing a port of a distribution head which includes a plug having threads of the type referred to by the ANSI as "American National Standard Straight Pipe Thread for Free-fitting Mechanical Joints" (NPSM threads).

The present invention additionally contemplates an apparatus for sealing a port which includes a plug having threads of the type referred to by the ANSI as "American National Standard Straight Pipe Thread for Loose-fitting Mechanical Joints with Locknuts" (NPSL threads).

BRIEF DESCRIPTION OF THE DRAWINGS

Other features and advantages of the invention will be apparent from the following description taken in connection with the accompanying drawings, wherein.

DETAILED DESCRIPTION OF THE PREFERRED EMBODIMENTS

Figure 1:
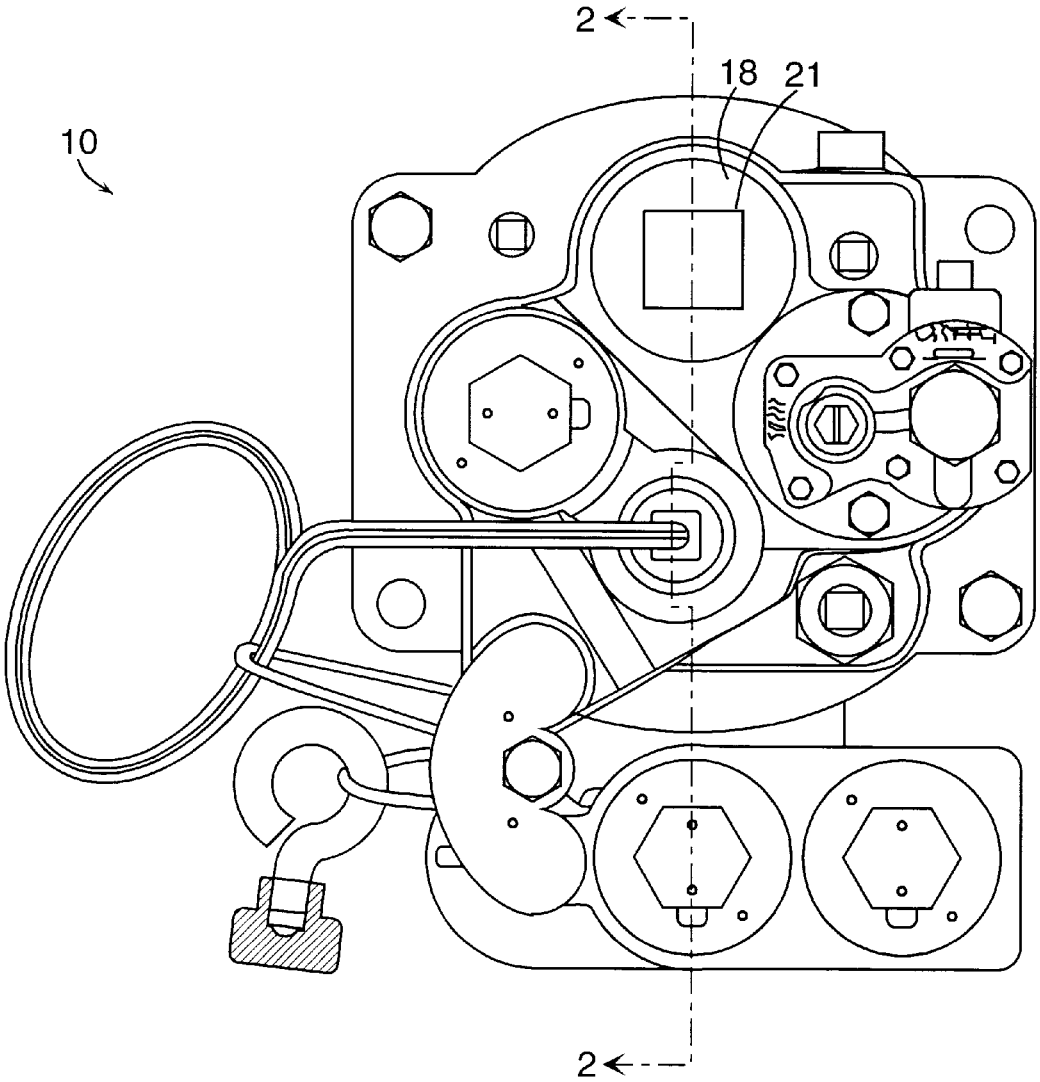
FIG. 1 is a top view showing the present invention in an operative relationship with a standard distribution head.
Figure 2:
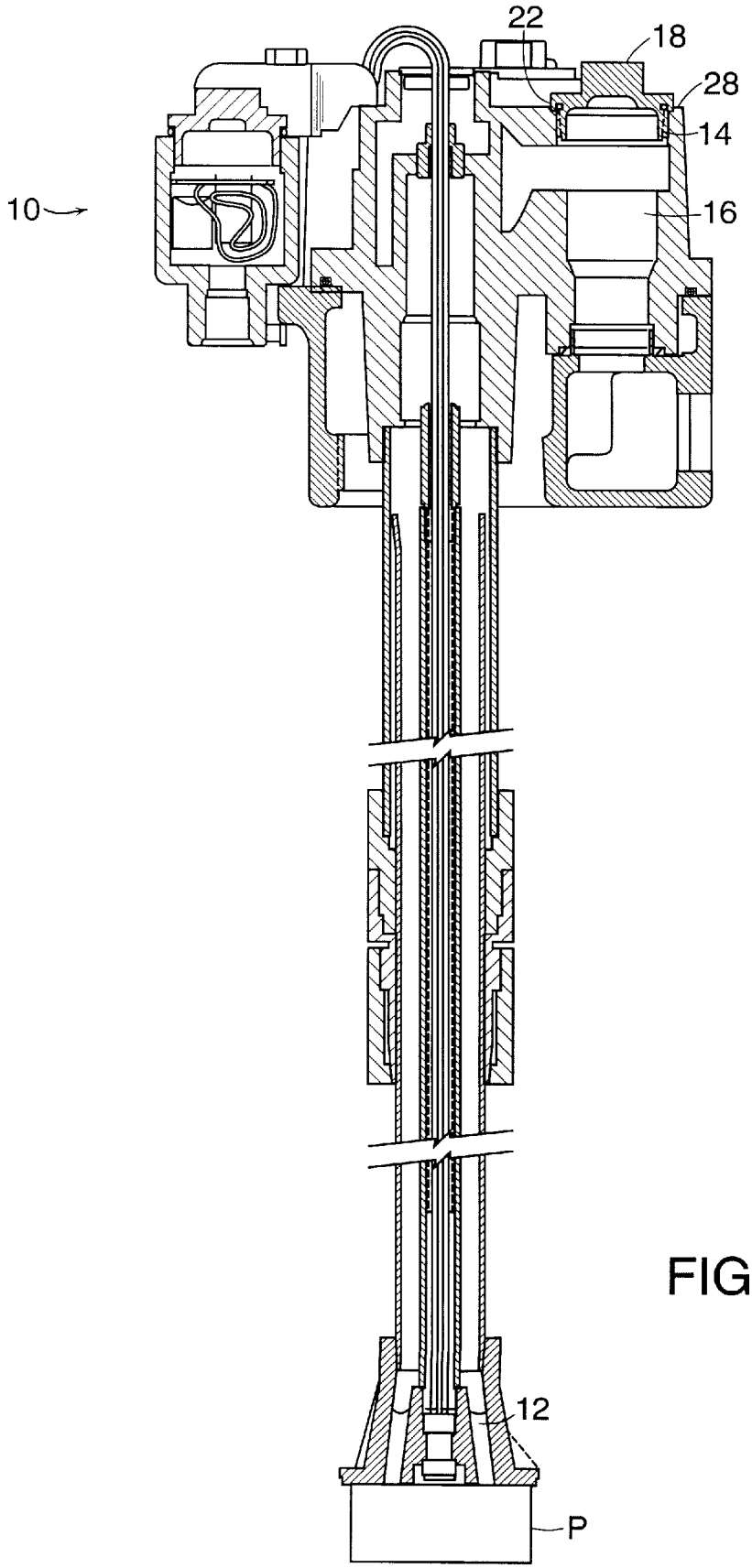
FIG. 2 is a sectional view taken along lines 2—2 of FIG. 1.

Referring now to the drawings in more detail and initially to FIG. 1, numeral 10 generally designates a distribution head which is used in a pumping system of the type that operates to pump flammable fulel such as gasoline from an underground storage tank to one or more above-ground dispensing units. This type of pumping system is commonly found in gasoline service stations. The distribution head 10 is also referred to in the industry as a packer. With additional reference to FIG. 2, the distribution head 10 receives the fuel which is delivered to it by a pump outlet 12 of a pump P, and directs the fuel to one or more above ground dispensing units (not shown). The distribution head 10 is provided with a port 14 which includes a chamber 16 for housing various devices, such as a pressure regulator. Access to the port 14 is obtained by removal of a plug 18.

Figure 3:
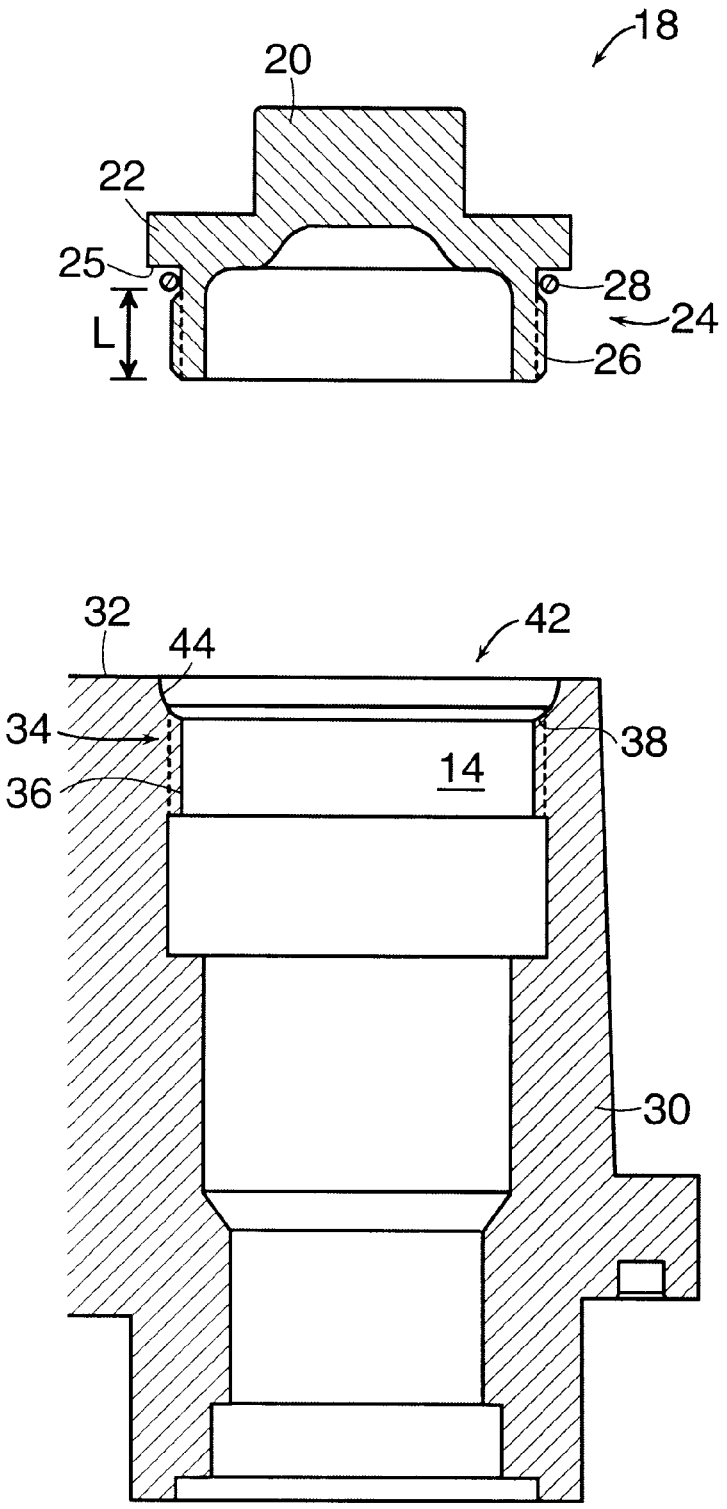
FIG. 3 is an enlarged sectional view of the port and plug of FIG. 2, wherein the plug is not engaged with the port.
Figure 5A:
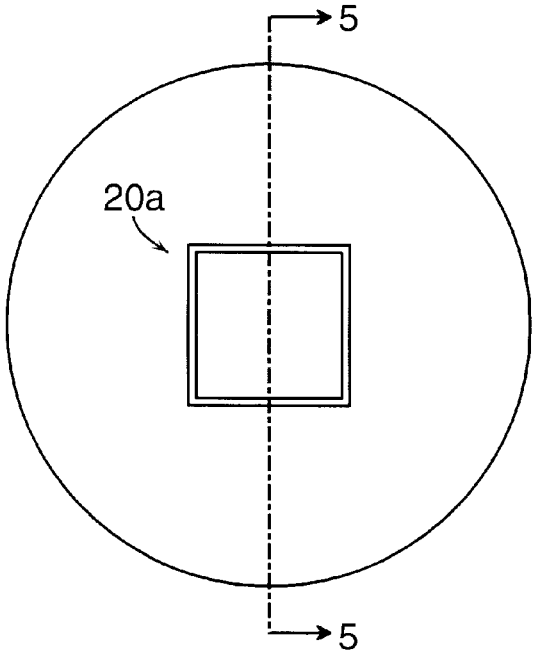
FIG. 5A is enlarged view of an alternative head style for the plug.
Figure 5B:
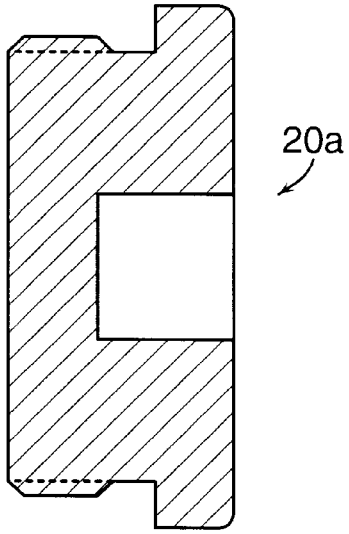
FIG. 5B is an enlarged sectional view taken along the line 5—5 of FIG. 5A.
Figure 6A:
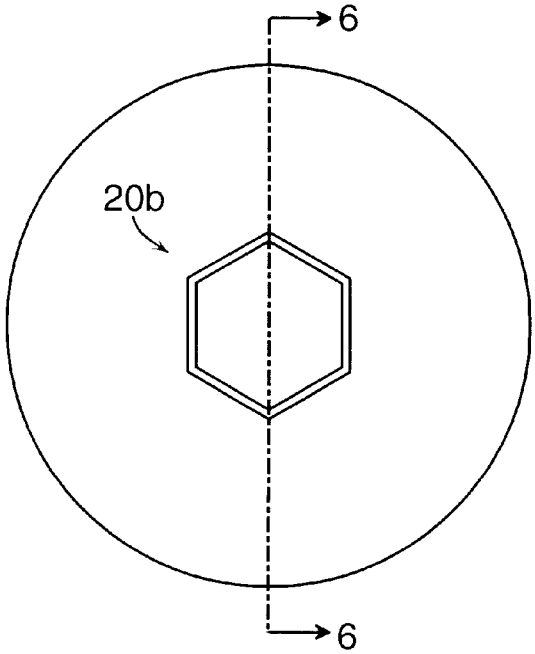
FIG. 6A is an enlarged sectional view of another alternative head style for the plug.
Figure 6B:
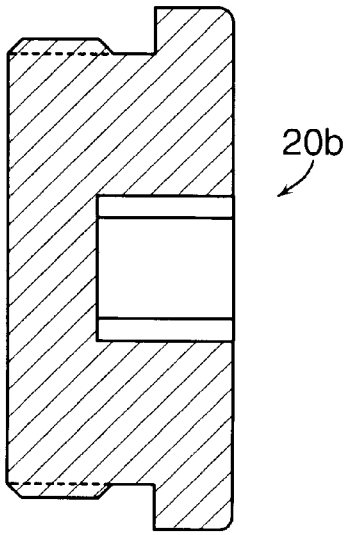
FIG. 6B is an enlarged section view taken along the line 6—6 of FIG. 6A.
Figure 7:
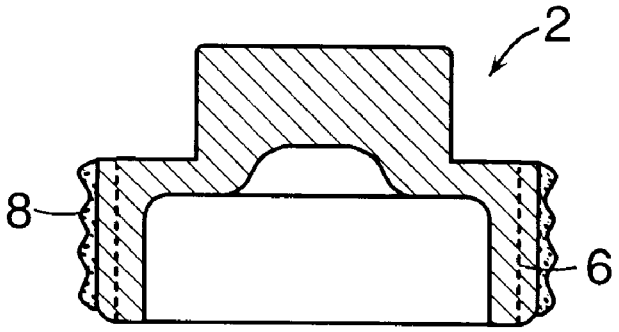
FIG. 7 PRIOR ART
FIG. 7 is a sectional view of a conventional plug and port.
Figure 7:
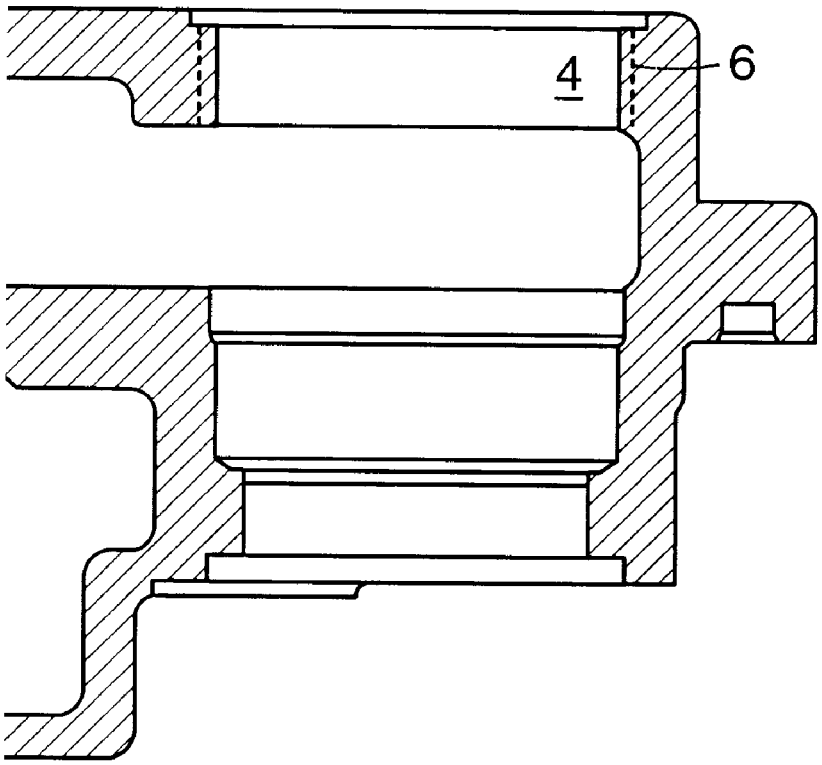
FIG. 7 PRIOR ART

An illustrative embodiment of the plug 18 according to the invention is generally shown in FIG. 3. The plug 18 includes a head 20, a flange 22, and a shank 24. The head 20 has a plurality of flats 21 (see FIG. 1) and is adapted to be turned by hand or a suitable wrench. Alternatively, the plug may be formed with a number of other head styles, including a square socket head 20*a* (see FIGS. 5A–5B) or a hex socket head 20*b* (see FIGS. 6A–6B), which are also adapted to be turned by hand or suitable wrench. The flange 22 extends radially and has a seal engagement surface 25. The shank 24 includes NPT type threads 26 formed thereon. An elastomeric seal member 28, such as an o-ring, is positioned at the seal engagement surface 25.

A base portion 30 of the distribution head 10 includes an external surface 32 and an inwardly extending area forming the port 14. An internally threaded portion 34 is formed within the port 14 and includes NPT type threads 36 which are operative to engage with the external NPT threads 26 of the plug 18. A gland 38 is formed near one end of the threaded portion 34 of the port 14. In addition, an o-ring receiving portion 42 having a chamfer 44 is formed near the opening of the port 14.

The operation of the present invention will now be described.

Figure 4:
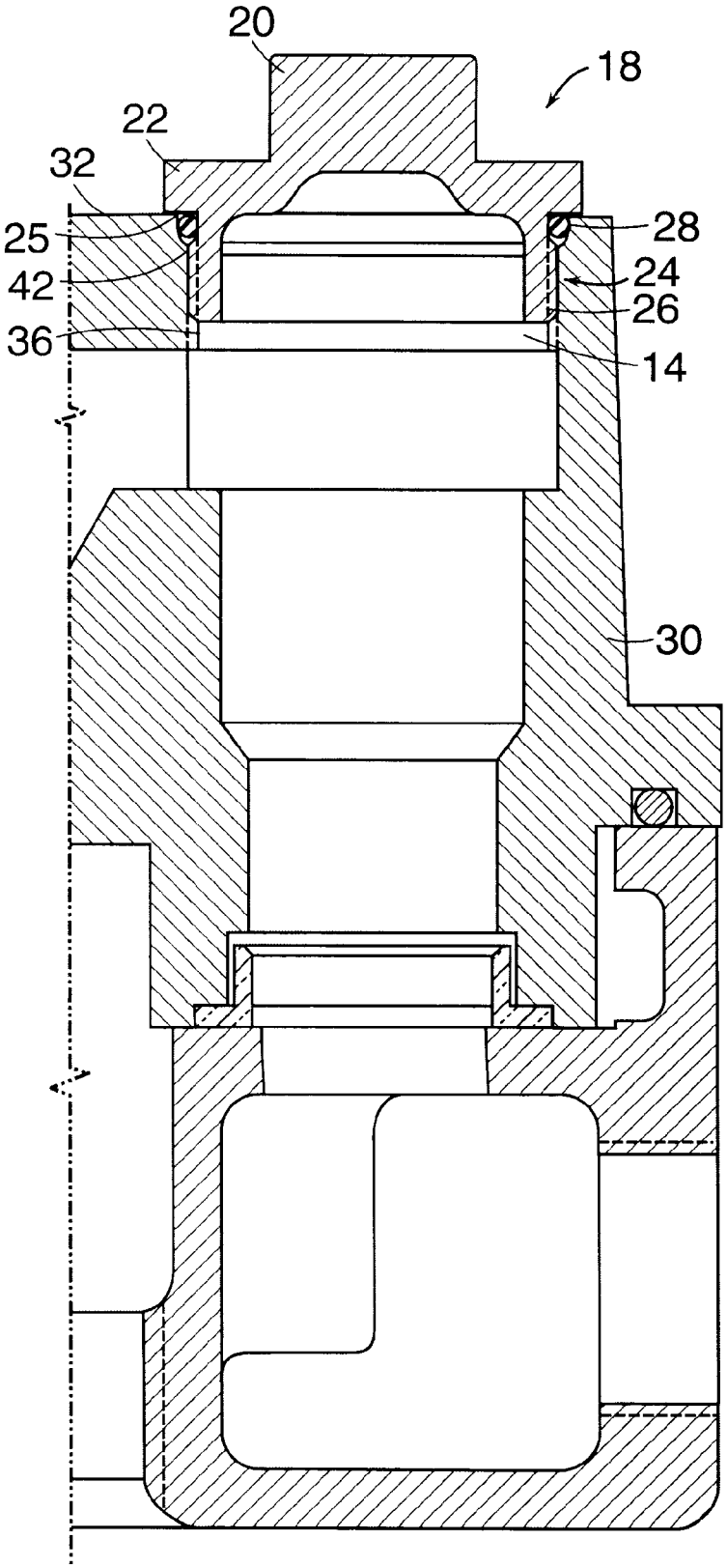
FIG. 4 is an enlarged sectional view of the port and plug of FIG. 2, wherein the plug is engaged with the port.

The shank 24 of the plug 18 is placed into the opening of the port 14, achieving mutual engagement between the NPT threads 26 on the plug 18 and NPT threads 36 in the port 14. Thereupon, turning of the plug 18 advances the plug 18 until the flange 22 is fully seated upon the external surface 32 of the distribution head 10 and the NPT threads 26 on the shank 24 are fully threadedly engaged with the NPT threads 36 in the port 14, as shown in FIG. 4. The act of the flange being brought against a surface of the port is commonly referred to as "bottoming out" of the plug, because this is the point at which the plug cannot be further rotated into the port.

Thus, prior to interference of the NPT threads 26 on the plug 18 with the NPT threads 36 of the port 14, the external surface 32 of the distribution head 10 resists further axial movement of the flange 22, whereby the o-ring 28 is compressed between the seal engagement surface 25 of the flange 22 and the o-ring receiving portion 42 of the port 14, providing a sealing effect between the two. The gland 38 at one end of the NPT threads 36 in the port 14 is adapted to protect the o-ring 28 during compression.

Thus, a means for sealing in the present invention preferably includes, but not necessarily, the o-ring 18, the seal engagement surface 28, and the o-ring receiving portion 42.

In addition, length L of the external NPT threads 26 on the plug 18, is less than in a conventional plug. By using a shorter length of threads, the plug tends to bottom out before the NPT threads have an opportunity to achieve an interference fit, because the external surface 32 abuts against the flange 22 sooner than in a conventional plug. In other words, the plug 18 "bottoms out" before the NPT threads 26, 36 achieve an interference fit. As a result, at all areas of thread engagement, the external NPT threads 26 on the plug 18 never form an interference fit with the internal NPT threads 36 of the port 14. Thus, the plug 18 is in a state wherein it is sufficiently engaged and sealed within the port 14 and is capable of being removed from the port 14 with minimal torque.

Thus, a means for preventing an interference fit in the present invention preferably includes, but not necessarily, the flange 22, the length L of threads which are shorter than a conventional plug, and the sealing means.

In one example of the present invention, an interference fit is prevented between a 2-inch NPT threaded plug and port, when the plug includes a thread length of approximately 0.527 inches. In a comparative example of a conventional plug which achieves an interference fit with a port, the same overall dimensions are provided except the thread length is 0.875 inches. Thus, by reducing the length of the threads in the plug of the present invention, an interference fit is prevented.

Although the invention is described as using NPT threads on the plug, it will also be appreciated that the external threading of the plug may be an American National Standard Straight Pipe Thread for Free-fitting Mechanical Joints (NPSM threads) or American National Standard Straight Pipe Thread for Loose-fitting Mechanical Joints with Locknuts (NPSL threads). As with the NPT threads discussed above, the NPSM or NPSL threads can also be formed on the plug so that it "bottoms out" before the threads achieve an interference fit, thus, allowing for easier removal than conventional plug and port systems.

Moreover, the present invention provides an advantage wherein other devices with NPT threads can be used in the port if desired. Thus, the modifications of the port in this invention still allow for a conventional NPT plug to be used therewith, and thus, a distribution head incorporating the port of the present invention is still useful for other applications.

It is contemplated that numerous modifications may be made to the apparatus and method of the present invention without departing from the spirit and scope of the invention as defined in the claims.

What is claimed is:

1. A distribution head of a fuel dispensing system having a leak detector port with a plug, said distribution head comprising:

a port formed within said distribution head, said port having American National Standard Taper Pipe Threads (NPT threads) formed therein;

a plug including a head portion, a flange, and a threaded shank for threadably engaging with said port, wherein said flange extends radially beneath said head portion, and has a seal engagement face surface; and a sealing member disposed on said seal engagement surface of said flange for forming a seal between said flange and said port, wherein said plug bottoms out in a fully engaged position with respect to said port without said threaded shank of said plug having an interference fit with the NPT threads of said port.

2. The distribution head of claim 1, wherein said threaded shank includes NPT threads.

3. The distribution head of claim 1, wherein said threaded shank includes American National Standard Straight Pipe Threads for Free-fitting Mechanical Joints (NPSM threads).

4. The distribution head of claim 1, wherein said threaded shank includes American National Standard Straight Pipe Thread for Loose-fitting Mechanical Joints with Locknuts (NPSL threads).

5. The distribution head of claim 1, further including a sealing member receiver portion formed within said port for receiving said sealing member.

6. The distribution head of claim 1, further including a gland formed on a top portion of said NPT threads in said port.

7. The distribution head of claim 1, wherein said sealing member is an elastomeric seal.

8. The distribution head of claim 7, wherein said elastomeric seal is an o-ring.

9. A plug for sealing a port having American National Standard Taper Pipe Threads (NPT threads), said plug comprising:

a head;

a flange extending radially beneath said head, said flange having a seal engagement face surface;

a sealing member disposed on said seal engagement surface of said flange for forming a seal;

a shank extending below said flange; and a thread formed on a portion of said shank, said thread being operative to rotatably engage with the port having NPT threads, wherein said plug bottoms out in a fully engaged position with respect to the port without said shank having an interference fit with the NPT threads of the port.

10. A method of plugging a port, comprising the steps of:

providing a plug having a flange, a sealing member and a shank with American National Standard Taper Pipe Threads (NPT threads) formed thereon;

providing a port with an NPT threaded portion and a sealing member receiving portion;

engaging said NPT threads of said plug with said NPT threaded portion of said port; and turning said plug until said plug bottoms out, so that an interference fit is prevented, while a seal is formed between said plug and said port by said sealing member.

11. A distribution head for a fuel dispensing system having a leak detector port with a plug, said distribution head comprising:

a plug including a threaded shank;

a port, for receiving said plug, including an internally threaded portion having American National Standard Taper Pipe Threads (NPT threads) formed thereon;

means for sealing said plug with said port; and means for preventing an interference fit between said threaded shank of said plug and said NPT threads of said port.

12. A distribution head of a fuel dispensing system having a leak detector port with a plug, said distribution head comprising:

a port formed within said distribution head, said port having American National Standard Taper Pipe Threads (NPT threads) formed therein;

a plug including a head portion, a flange and a threaded shank for threadably engaging with said port, wherein said flange extends radially beneath said head portion, and has a seal engagement face surface; and a sealing member disposed on said seal engagement surface of said flange for forming a seal between said flange and said port, wherein said threaded shank is operative to be fully threadedly engaged with said port while having a non-interference fit.

13. A distribution head of a fuel dispensing system having a leak detector port with a plug, said distribution head comprising:

a port formed within said distribution head, said port having American National Standard Taper Pipe Threads (NPT threads) formed therein;

a plug including a head portion, a flange and a threaded shank for threadably engaging with said port, wherein said flange extends radially beneath said head portion, and has a seal engagement face surface; and a sealing member disposed on said seal engagement surface of said flange for forming a seal between said flange and said port, wherein the seal formed between said flange and said port provides resistance to turning of said plug so as to prevent an interference fit between said threaded shank and said threads of said port.

* * * * *